US008297242B2

(12) United States Patent
Persson et al.

(10) Patent No.: US 8,297,242 B2
(45) Date of Patent: Oct. 30, 2012

(54) EXHAUST VALVE MECHANISM FOR AN INTERNAL COMBUSTION ENGINE

(75) Inventors: Per Persson, Partille (SE); Göran Olsson, Göteborg (SE)

(73) Assignee: Volvo Lastvagnar AB, Göteborg (SE)

( * ) Notice: Subject to any disclaimer, the term of this patent is extended or adjusted under 35 U.S.C. 154(b) by 233 days.

(21) Appl. No.: 12/665,941

(22) PCT Filed: Jun. 26, 2007

(86) PCT No.: PCT/SE2007/000625

§ 371 (c)(1),
(2), (4) Date: Jan. 25, 2010

(87) PCT Pub. No.: WO2009/002234

PCT Pub. Date: Dec. 31, 2008

(65) Prior Publication Data

US 2010/0186710 A1 Jul. 29, 2010

(51) Int. Cl.

| | |
|---|---|
| ***F01L 1/34*** | (2006.01) |
| ***F01L 1/18*** | (2006.01) |
| ***F02D 13/04*** | (2006.01) |

(52) U.S. Cl. ..... 123/90.16; 123/90.39; 123/321

(58) Field of Classification Search ..... 123/27 R, 123/90.15, 90.16, 315, 320, 321, 322, 676; 701/102, 103; 60/285

See application file for complete search history.

(56) References Cited

U.S. PATENT DOCUMENTS

| | | | | |
|---|---|---|---|---|
| 6,983,725 | B2 * | 1/2006 | Persson | 123/90.16 |
| 2004/0237932 | A1 * | 12/2004 | Persson | 123/321 |
| 2006/0112918 | A1 | 6/2006 | Persson | |
| 2007/0028878 | A1 * | 2/2007 | Persson et al. | 123/90.39 |

OTHER PUBLICATIONS

International Search Report for corresponding International Application PCT/SE2007/000625.

* cited by examiner

*Primary Examiner* — Stephen K Cronin
*Assistant Examiner* — Sherman Manley
(74) *Attorney, Agent, or Firm* — WRB-IP LLP

(57) ABSTRACT

In an exhaust valve mechanism for an internal combustion engine the main rocker arm is mounted on a rocker arm shaft for normal valve operation via a cam element. A secondary rocker arm is mounted on the shaft for activation of an exhaust brake mode. The activation is achieved through supply of hydraulic pressure to a piston cylinder arrangement acting between the main and secondary rocker arms. A master piston and a slave piston are connected by a hydraulic-link allowing activation by increased hydraulic pressure. When activating the exhaust gas temperature increasing mode, the master piston is moved to an active position for part of its stroke against the force of a first resilient member. When activating the exhaust brake mode, the master piston is moved the full movement of its stroke against the combined forces of the first resilient member and a second resilient member as active position. The end of the first stroke length defines a position for the master piston allowing activation of an extra valve event.

10 Claims, 2 Drawing Sheets

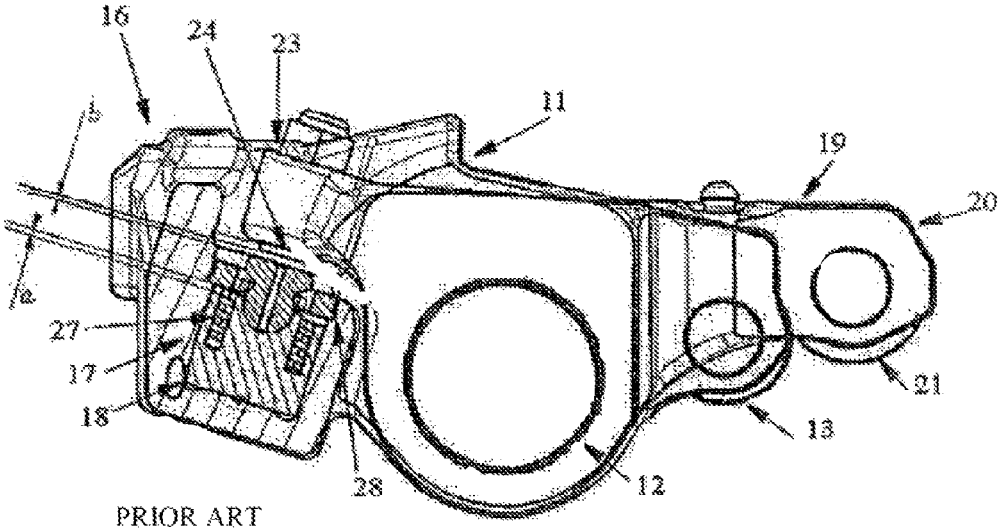
PRIOR ART
FIG. 2
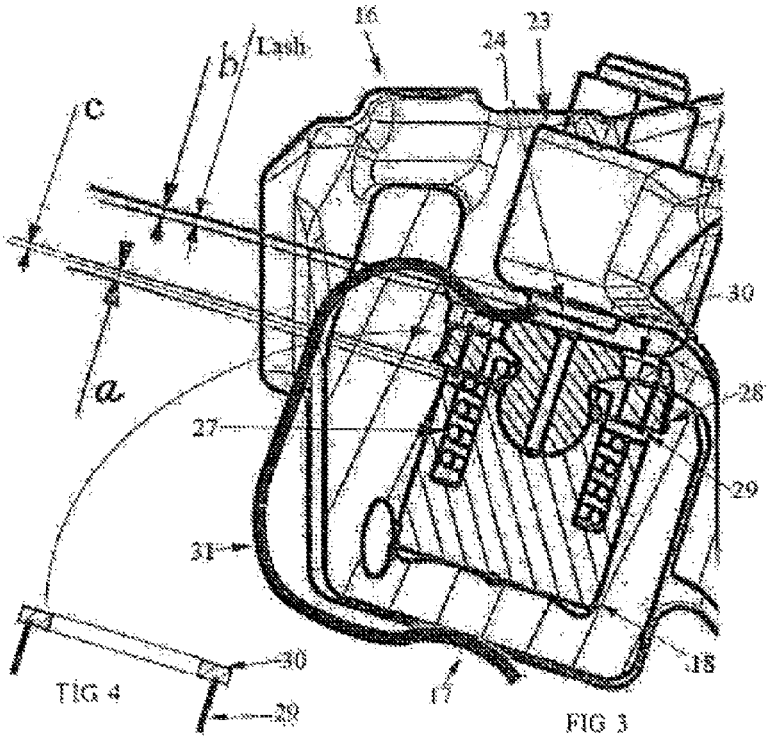
FIG 4
FIG 3

EXHAUST VALVE MECHANISM FOR AN INTERNAL COMBUSTION ENGINE

BACKGROUND AND SUMMARY

The invention relates to an exhaust valve mechanism for an internal combustion engine.

When a heavy duty Diesel engine is operated under low load and/or idling, the exhaust temperature is low or even far too low for an Exhaust After Treatment System (EATS) comprising a catalyst to function properly. At low engine speeds, it is typically necessary to provide an auxiliary burner in the post-turbine exhaust. Such a solution involves the use of additional fuel.

One way to modify the thermodynamic process of the engine during low load operation in order to increase the exhaust temperature is to shorten the duration of the expansion stroke. A shortened expansion stroke will result in less torque to crankshaft and energy remaining in the exhaust gas expressed as higher temperature. This elevated exhaust temperature is very beneficial for the function of EATS. The reduced torque delivered to the crankshaft has to be compensated by increased fuelling, which further on will increase exhaust temperature.

An engine valve mechanism is needed which is able to switch between a normal mode of operation and a low load mode of operation to open the exhaust valves against the cylinder pressure a short duration (10-60° crank angle) after low load combustion. For a heavy duty truck engine, the valve mechanism also in many cases should be able to operate in brake mode to decompress the cylinder gas pressure just before TDC in the compression stroke.

Several engine valve systems of the so called lost motion type are known in the field that are able to perform several different valve motion events. However, these systems rely on electronic control by crank angle resolution of a hydraulic link in the valve train mechanism between camshaft and valve. Thus, these systems require an electric actuator for each cylinder. The complexity of these valve control systems makes them expensive and functionally more vulnerable than a mechanical system.

An exhaust valve mechanism for an internal combustion engine is disclosed in U.S. Pat. No. 6,983,725 B2. Each exhaust rocker arm is provided with two hydraulic pistons with a hydraulic communication. The pistons are engaged during engine brake operation. One piston, the slave piston, is situated between valve yoke and exhaust rocker arm. When the exhaust brake system is activated, the slave piston and the hydraulic cushion will adjust the valve lash to zero between exhaust rocker (exhaust cam lobe) and exhaust valves. The other piston, the master piston, is pushed by hydraulic pressure against its stop ring at upper position when the system is engaged. A brake cam lobe engages a brake rocker arm and the movements of the brake rocker are transmitted via a hydraulic link between the master piston and the slave piston to the exhaust rocker arm to perform the engine brake events.

It is desirable to provide a hydraulic valve actuation system with more than two operating modes without the need for electronic control means.

According to an aspect of the present invention, an exhaust valve mechanism is characterized in that a second resilient member acts on the hydraulic link with a spring rate lower than said first resilient member to allow the activation of an extra valve event.

BRIEF DESCRIPTION OF THE DRAWINGS

The invention will be described in more detail here below with reference to examples shown in the accompanying drawings, in which FIG. 2 is a side view of the main rocker arm (partially in section) and a brake rocker arm of a valve mechanism in accordance with FIG. 1, FIG. 3 is a partial enlargement of FIG. 2, showing components added in accordance with an embodiment of the present invention, and FIG. 4 is a section through a washer with distance rods.

DETAILED DESCRIPTION

Figure 1:
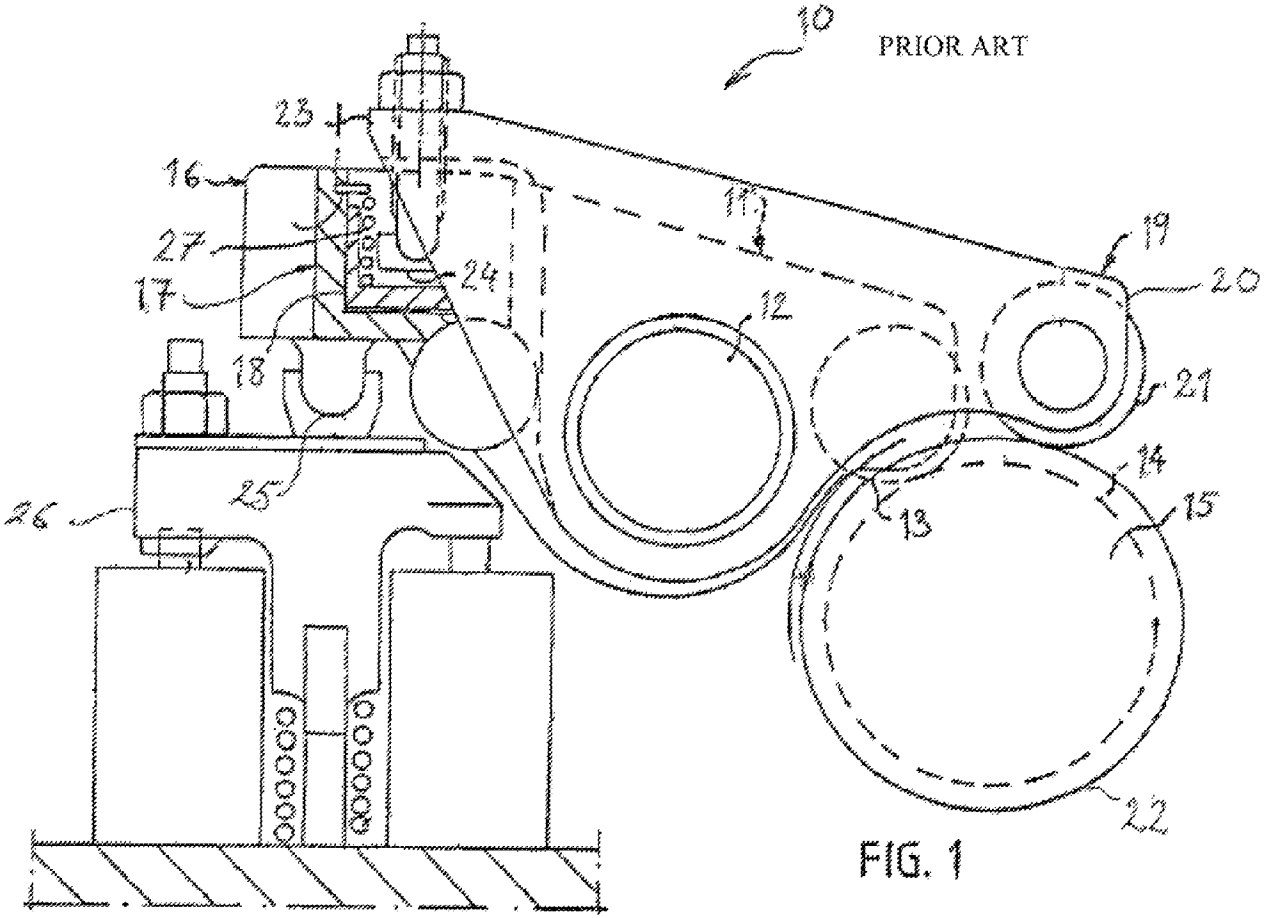
FIG. 1 is a schematic side view of a prior art valve mechanism according to the invention with the rocker arm for braking mode and with the rocker arm for regular valve lift partially in section.

FIG. 1 schematically illustrates a prior art valve mechanism 10 as described in U.S. Pat. No. 6,983,725 for use in an internal combustion engine (not shown). The mechanism 10 comprises a main exhaust valve rocker arm 11, which is rockably mounted on a rocker arm shaft 12. One end of the main rocker arm 11 has a cam follower roller 13, rotatably mounted thereon. The cam follower roller 13 is in contact with a schematically shown cam element 14 on the camshaft 15. At its end 16 opposite to the end with the cam follower roller 13, the main rocker arm 11 is provided with a piston cylinder arrangement 17 comprising a master piston 18 and a slave piston 25 located in two corresponding piston cylinders in the main rocker arm end 16.

A secondary rocker arm 19 is arranged beside the main rocker arm and mounted on the rocker arm shaft 12 for activation of an exhaust brake mode. One end 20 of the secondary rocker arm 19 has a cam follower roller 21, rotatably mounted thereon. The cam follower roller 21 is in contact with a schematically shown separate brake cam element 22 on the camshaft 15. At its end 23 opposite to the end with the cam follower roller 21, the secondary rocker arm 19 is provided with a nose member 24 which the master piston 18 is brought into contact with, when the piston cylinder arrangement 17 is activated.

The activation of the brake mode is achieved through supply of hydraulic pressure to the piston cylinder arrangement 17 acting between the main and secondary rocker arms via a check valve connected to a hydraulic control system. An increase of the hydraulic link pressure results in the slave piston 25 being loaded downwards in the figures towards the valve yoke 26 so that the valve lash clearance between the yoke and the upper end surfaces of the valve spindles is adjusted down to zero. The increased pressure in the hydraulic link also moves the master piston 18 upwards in the figures against the force of the helical spring 27 acting between the master piston 18 and a stopper ring 28, until it contacts the nose member 24 of the secondary rocker arm 19. Now the brake cam element 22 can provide brake mode valve events to the valves via the above described hydraulic link.

In order to provide the extra valve events in accordance with the invention, the hydraulic link is provided with a second resilient member acting with a spring force added to the spring force of the helical spring 27 when the piston 18 is in contact with the rods 29. As FIG. 3 shows, the stopper ring 28 is provided with a set of apertures for a corresponding set of distance rods 29 reaching through the stopper ring to define an intermediate position for the master piston 18. The distance rods 29 are mounted on a washer 30 which is pressed against the stopper ring 28 by means of a leaf spring 31. The leaf spring 31 has pretension when washer 30 is resting on stopper ring 28.

In the intermediate position, the secondary rocker arm is able to perform the extra valve events with a smaller valve lift than the above described brake mode valve events when the hydraulic link is activated with a certain hydraulic pressure which is able to overcome the spring force of the helical spring 27. Now the lash clearance between the yoke and the upper end surfaces of the valve spindles is adjusted down to zero and the master piston 18 is moved upwards in the figure until it rests against the ends of the rods 29. In this position, the nose member 24 of the secondary rocker arm 19 will make contact with the master cylinder to make valve lift events corresponding to the pre-opening of exhaust valves after combustion and shortening expansion stroke as well as increasing exhaust gas temperature described above, but with shorter lift and duration than a complete engine brake event.

In FIG. 3 the measurement "a" illustrates the total stroke length of the master piston 18. The measurement "b" illustrates the clearance between the top of the master piston and the nose member 24 when fully-disengaged (hydraulic pressure pi, no engagement) and both rocker arms resting on the base circle of the cam shaft. The measurement "c" illustrates the distance the rods 29 protrude through the stopper ring 28. When the master piston is activated with intermediate hydraulic pressure p2/the lash equals measurements b−(a−c) (partially engaged). When fully engaged as in engine brake mode, the hydraulic pressure p3 overcomes the spring rates of both the helical spring 27 and the leaf spring 31 to make the lash zero.

The invention is not limited to the above described embodiment, but several modifications are possible within the scope of the claims. For example, other means than the leaf spring 31, e.g. a cup spring located inside the master piston cylinder with a lash between the stopper ring and the master piston, may be used for providing the sum of spring forces from the two springs described above.

The invention claimed is:

1. Exhaust valve mechanism for an internal combustion engine with at least one exhaust valve in each engine cylinder, comprising:

a main rocker arm for each cylinder mounted on a rocker arm shaft for normal operation of the exhaust valve by actuation by a camshaft cam element; and a secondary rocker arm arranged on the main rocker arm and mounted on the rocker arm shaft for activation of an exhaust brake mode, which activation is achieved through supply of hydraulic pressure to a piston cylinder arrangement acting between the main and secondary rocker arms, the piston cylinder arrangement comprising a master piston and a slave piston connected by a hydraulic link which allows activation by increased hydraulic pressure supplied to increase the piston stroke length of the hydraulic link, wherein the master piston, during activation of an exhaust gas temperature increasing mode, is moved from an inactive position to an active position by the hydraulic pressure for a part of its stroke length against the spring force of a first resilient member and for the rest of its stroke length against the combined spring forces of the first resilient member and a second resilient member acting directly against the master piston, and that the end of the first stroke length defines a position for the master piston that allows the activation of an extra valve event.

2. Exhaust valve mechanism according to claim 1, wherein the first resilient member is a helical spring positioned between the master piston and a stopper ring to bias the master piston towards an inactive end position.

3. Exhaust valve mechanism for an internal combustion engine with at least one exhaust valve in each engine cylinder, comprising:

a main rocker arm for each cylinder mounted on a rocker arm shaft for normal operation of the exhaust valve by actuation by a camshaft cam element; and a secondary rocker arm arranged on the main rocker aim and mounted on the rocker arm shaft for activation of an exhaust brake mode, which activation is achieved through supply of hydraulic pressure to a piston cylinder arrangement acting between the main and secondary rocker arms, the piston cylinder arrangement comprising a master piston and a slave piston connected by a hydraulic link which allows activation by increased hydraulic pressure supplied to increase the piston stroke length of the hydraulic link, wherein the master piston, during activation of an exhaust gas temperature increasing mode, is moved from an inactive position to an active position by the hydraulic pressure for a part of its stroke length against the spring force of a first resilient member and for the rest of its stroke length against the combined spring forces of the first resilient member and a second resilient member, and that the end of the first stroke length defines a position for the master piston that allows the activation of an extra valve event, the first resilient member is a helical spring positioned between the master piston and a stopper ring to bias the master piston towards an inactive end position, and the stopper ring is provided with a set of apertures for a corresponding set of distance rods reaching through the stopper ring to define an intermediate position for the master piston.

4. Exhaust valve mechanism according to claim 3, wherein the distance rods are fixed to a washer which is biased by the first resilient member towards the stopper ring.

5. Exhaust valve mechanism for an internal combustion engine with at least one exhaust valve in each engine cylinder, comprising:

a main rocker arm for each cylinder mounted on a rocker arm shaft for normal operation of the exhaust valve by actuation by a camshaft cam element; and a secondary rocker arm arranged on the main rocker arm and mounted on the rocker arm shaft for activation of an exhaust brake mode, which activation is achieved through supply of hydraulic pressure to a piston cylinder arrangement acting between the main and secondary rocker arms, the piston cylinder arrangement comprising a master piston and a slave piston connected by a hydraulic link which allows activation by increased hydraulic pressure supplied to increase the piston stroke length of the hydraulic link, wherein the master piston, during activation of an exhaust gas temperature increasing mode, is moved from an inactive position to an active position by the hydraulic pressure for a part of its stroke length against the spring force of a first resilient member and for the rest of its stroke length against the combined spring forces of the first resilient member and a second resilient member, and that the end of the first stroke length defines a position for the master piston that allows the activation of an extra valve event, wherein the second resilient member is a U-shaped leaf spring.

6. Exhaust valve mechanism according to claim 1, wherein the internal combustion engine is a compression ignition engine.

7. Exhaust valve mechanism according to claim 6, wherein the extra valve event takes place after injection during the expansion stroke.

8. Exhaust valve mechanism according to claim 7, wherein the extra valve event takes place during a low load mode of operation to open the exhaust valves against the cylinder pressure a short duration after low load combustion.

9. Exhaust valve mechanism according to claim 6, wherein the extra valve event is utilized for elevating the exhaust gas temperature to enhance the function of an Exhaust After Treatment System.

10. Exhaust valve mechanism according to claim 8, wherein the extra valve event takes place during a low load mode of operation to open the exhaust valves against the cylinder pressure for between a 10-60° crank angle after low load combustion.

* * * * *